US007441333B2

(12) United States Patent
Sugiyama

(10) Patent No.: US 7,441,333 B2
(45) **Date of Patent: *Oct. 28, 2008**

(54) ASSEMBLY DEVICE OF SUPPORT MAT FOR CERAMIC CATALYST CARRIER

(75) Inventor: Yasuhiro Sugiyama, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 623 days.

This patent is subject to a terminal disclaimer.

(21) Appl. No.: 11/019,198

(22) Filed: Dec. 23, 2004

(65) Prior Publication Data

US 2005/0142044 A1 Jun. 30, 2005

(30) Foreign Application Priority Data

Dec. 26, 2003 (JP) ..... 2003-433761

(51) Int. Cl.
*B21D 51/16* (2006.01)

(52) U.S. Cl. ..... 29/890; 425/409; 425/422

(58) Field of Classification Search ..... 29/890; 425/394, 397, 403, 403.1, 409, 422, 438
See application file for complete search history.

(56) References Cited

U.S. PATENT DOCUMENTS 1,200,190 A * 10/1916 Hahnemann ..... 413/73
4,144,627 A * 3/1979 Noda et al. ..... 29/890
4,513,596 A * 4/1985 Usher ..... 72/51
6,769,281 B2 * 8/2004 Irie et al. ..... 72/121
7,137,199 B2 * 11/2006 Schug et al. ..... 29/890
2004/0022699 A1 * 2/2004 Fukushima ..... 422/179
2004/0031556 A1 * 2/2004 Kaneko et al. ..... 156/185
2005/0147708 A1 * 7/2005 Sugiyama et al. ..... 425/394
2006/0016063 A1 * 1/2006 Gharib ..... 29/521

FOREIGN PATENT DOCUMENTS

EP 1 344 911 A1 9/2003
JP 7-269334 A 10/1995
JP 9-264126 A 10/1997
JP 10-131744 A 5/1998

* cited by examiner

*Primary Examiner*—David P. Bryant
*Assistant Examiner*—Christopher M Koehler
(74) *Attorney, Agent, or Firm*—Foley & Lardner LLP

(57) ABSTRACT

An assembly device of a support mat for a ceramic catalyst carrier includes: a push-in device provided in a vertically movable tool base and capable of pushing a ceramic catalyst carrier together with a support mat into a recession of a shaping die; a first and a second pressing unit pressing both end portions of the support mat from side faces so as to curve the both end portions of the support mat along an arc-shaped upper surface of the ceramic catalyst carrier; first pressing pieces and a second pressing piece provided in tip portions of the first and second pressing units; and a push-up unit provided on a bottom of the recession and capable of pushing up the ceramic catalyst carrier together with the support mat.

13 Claims, 7 Drawing Sheets

ASSEMBLY DEVICE OF SUPPORT MAT FOR CERAMIC CATALYST CARRIER

BACKGROUND OF THE INVENTION

1. Field of the Invention

The present invention relates to an assembly device automatically assembling a support mat to a ceramic catalyst carrier used in an exhaust system of a combustion engine of a motor vehicle, and others.

2. Description of the Related Art

A ceramic catalyst carrier with a support mat of a prior art is disclosed in Japanese Patent Application Laid-open No. Hei 10-131744. The ceramic catalyst carrier carrying a catalyst is wound around an outer periphery thereof with a metal support mat and the carrier with the support mat is housed in a container that constitutes a part of an exhaust passage of an exhaust system of a combustion engine. FIG. 6A shows a process chart illustrating plane viewed states of the support mat 101 and the ceramic catalyst carrier 103 in three steps of an assembly procedure of them, and FIG. 6B shows a process chart illustrating front viewed states of them corresponding to the steps of FIG. 6A.

As shown in FIG. 6A and FIG. 6B, the support mat 101 is assembled to a ceramic catalyst carrier 103 by using a jig 102 having a recession 102 with a semicircular cross section. Their assembly is performed by the following procedure below. First, a rectangular metal plate to be the support mat 101 and the ceramic catalyst carrier 103 are prepared. This support mat 101 is formed to have a main body, and engagement portions consisting of a depression 101*a* and a projection 101*b* that are provided in of the main body at both end portions in a winding direction of thereof, respectively, and can be fitted together with each other. The above formed support mat 101 is placed on the jig 102, and then the ceramic catalyst carrier 103 is pushed into the recession 102*a* of the jig 102, pressing the support mat 101 toward the recession 101 to deform a intermediate portion thereof, so that the intermediate portion of the support mat 101 is formed to curve along an arc-shaped bottom surface of the ceramic catalyst carrier 103. Then, the both end portions of the support mat 101, which are brought into a substantially perpendicularly standing state when the ceramic catalyst carrier 103 is pushed into the recession 102*a*, are pressed from both side portions thereof to approach each other so that the both end portions are curved along an arc-shaped upper surface of the ceramic catalyst carrier 103.

An adhesive seal 104 is pasted on the engagement portions where the depression 101*a* and the projection 101*b* are engaged with each other, to thereby tentatively join the both end portions of the support mat 101. Then, the ceramic catalyst carrier 103 having the support mat 101 assembled around the outer periphery thereof is taken out of the recession 102*a* of the jib 102. All these processes have been manually carried out.

However, since many work processes have been all manually carried out as described above in the prior art, work efficiency is poor and in addition, undesirable variations tend to occur occasionally in positioning accuracy when the support mat 101 is assembled to the ceramic catalyst carrier 103 and in the position and state of the pasted adhesive seal 104. This has posed problems that the support mat 101 may be poorly fitted to stick its part out of the container, the adhesive seal 104 may peel off or be tucked into the container, and other problems may occur when the assembled body is press-fitted in a container in a subsequent process.

It is an object of the present invention to provide an assembly device of a support mat for a ceramic catalyst carrier that is capable of improving work efficiency by automating many assembly processes and capable of enhancing positioning accuracy in assembling the support mat to the ceramic catalyst carrier, thereby preventing poor conditions that may possibly occur when the ceramic catalyst carrier with the support mat is press-fitted in a container constituting part of an exhaust passage of an exhaust system of a combustion engine.

SUMMARY OF THE INVENTION

An assembly device of a support mat for a ceramic catalyst carrier of the present invention includes: a base capable of holding a support mat in a flat plate shape substantially horizontally, the support mat having in both end portions a depression and a projection engageable with the depression; a shaping die provided on an intermediate portion of the base and having a recession that has a shape substantially fitting a semicircular bottom surface of the ceramic catalyst carrier; a push-in unit capable of pushing the ceramic catalyst carrier together with the support mat into the recession of the shaping die; a first pressing unit and a second pressing unit that press both end portions of the support mat from side faces so as to curve the both end portions of the support mat along an arc-shaped upper surface of the catalyst carrier; and a push-up unit provided on a bottom of the recession of the shaping die and capable of pushing up the ceramic catalyst carrier together with the support mat.

The assembly device of the support mat for the ceramic catalyst carrier of the present invention assembles the support mat to the ceramic catalyst carrier, for example, in the following order.

(a) An adhesive tape is fed onto an upper surface of one end portion of the base with an adhesive surface facing upward.

(b) The flat-plate-shaped support mat is placed on the base. At this time, the support mat is placed so that one of the both end portions of the support mat overlaps an upper surface of the adhesive tape, and the end portion is pressed from above so that the adhesive tape sticks to the end portion.

(c) The push-up unit is moved up to support a bottom of the support mat, and the push-in unit is moved down to be in contact with an upper surface of the catalyst carrier. In this state, the push-up unit and the push-in unit are both moved down to push the ceramic catalyst carrier together with the support mat into the recession of the shaping die, so that an intermediate portion of the support mat curves along the arc-shaped bottom surface of the ceramic catalyst carrier and the both end portions of the support mat are brought into a substantially perpendicularly standing state.

(d) The push-in unit is moved up.

(e) The first pressing unit and the second pressing unit press the both end portions of the support mat from the side faces so that the both end portions are curved along the arc-shaped upper surface of the ceramic catalyst carrier. In this state, the depression and the projection of the support mat are engaged with each other in a gap formed between the first pressing unit and the second pressing unit, and an adhesive tape is pressed onto the upper surfaces of the engagement portions. Consequently, the depression and the projection formed in the both end portions of the support mat are tentatively joined in the engaged state by the adhesive tape.

(f) The push-in unit is moved down to push the vicinity of the joint part of the both ends of the support mat together with the adhesive tape onto the upper surface of the ceramic catalyst carrier, thereby finishing the assembly. Consequently, the whole vicinity of the joint part of the both ends of the support mat together with the adhesive tape can be surely curved along the arc-shaped upper surface of the ceramic catalyst carrier.

(g) The first pressing unit and the second pressing unit are moved back.

(h) The push-in unit and the push-up unit are concurrently moved up, so that the ceramic catalyst carrier having the support mat assembled around the outer periphery thereof is pushed out of the recession of the shaping die.

(i) The push-in unit is further moved up and the ceramic catalyst carrier having the support mat assembled thereto is taken out of the device.

According to the assembly device of the support mat for the ceramic catalyst carrier, it is possible to automate many assembly processes and to enhance positioning accuracy in assembling the support mat to the ceramic catalyst carrier, thereby preventing poor conditions that may possibly occur when the assembled body is press-fitted into a container constituting part of an exhaust passage.

Preferably, the support mat has in the both end portions thereof a depression and a projection engageable with the depression.

This engagement prevents misalignment in a latitudinal direction of the support mat of the engagement portions of the depression and the projection.

Preferably, the assembly devices further comprises an automatic tape feeder to feed an adhesive tape to an upper surface of one end portion of the base.

This automatically tape feeding enables the adhesive tape to be arranged at the desired position of the base without undesirable variation.

Preferably, one of the first pressing unit and the second pressing unit that is to press one of the end portions of the support mat where the adhesive tape is not pasted is driven before the other one of the first and second pressing units is driven.

This pressing brings a certain stick of the adhesive tape to the upper surfaces of the engagement portions of the depression and the projection.

Preferably, the assembly device further comprises a tape/support mat pressing unit that presses the other end portion of the support mat toward the adhesive tape while the other end portion of the support mat is placed on an upper surface of the adhesive tape, thereby sticking the adhesive tape to the other end portion.

This pressing brings a certain stick of the adhesive tape to the other end portion of the support mat.

Preferably, the push-in unit is composed of: a tool base provided above the shaping die and driven by a first actuator to be vertically movable; and a push-in device provided in the tool base and driven by a second actuator to be capable of pushing the ceramic catalyst carrier together with the support mat into the recession of the shaping die; and the first pressing unit and the second pressing unit are provided on the tool base.

This decreases the number of the parts used in the assembly device, and improves its work efficiency.

Preferably, the assembly device further comprises a plurality of first pressing pieces and at least one second pressing piece that are integrally provided in tip portions of the first pressing unit and the second pressing unit respectively: the first pressing pieces covering areas of an upper surface excluding the depression in the depression-side end portion of the support mat; and the second pressing piece covering an area of the upper surface corresponding to the projection in the projection-side end portion of the support mat; and an elastic presser provided on a pressing surface of the push-in unit, having a thickness and elasticity, and capable of pressing the adhesive tape onto an upper surfaces of engagement portions of the depression and the projection of the support mat by pressing upper surfaces of the first pressing pieces and the second pressing piece.

This can prevent misalignment and wrinkle of the adhesive tape 15.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, embodiments of the present invention will be described with reference to the accompanying drawings.

An assembly device of a support mat for a ceramic catalyst carrier according to a first embodiment will be described with reference to the accompanying drawings of FIGS. 1 to 4.

Figure 1:
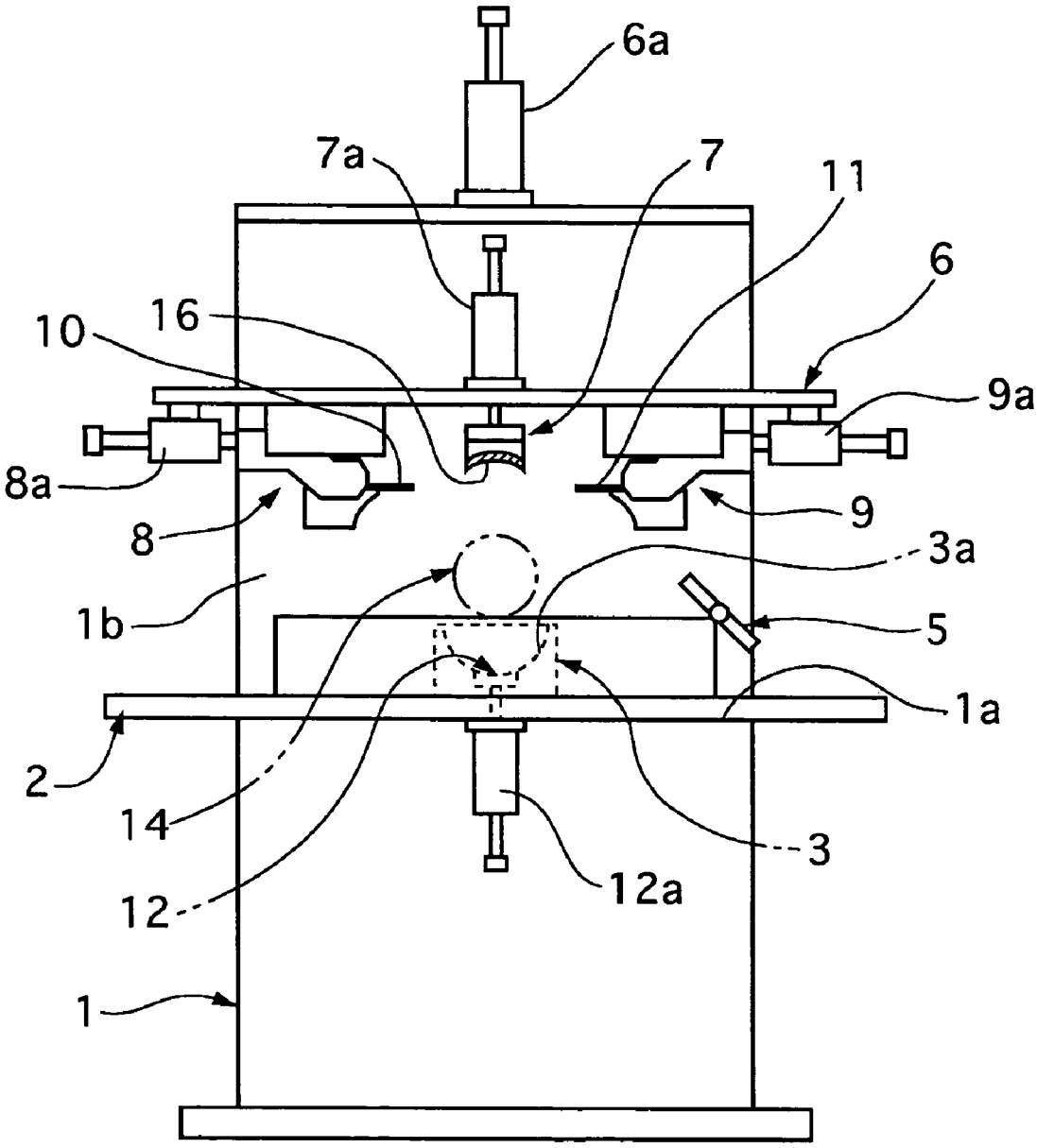
FIG. 1 is a front view showing an assembly device of a support mat for a ceramic catalyst carrier according to a first embodiment of the present invention.
Figure 2:
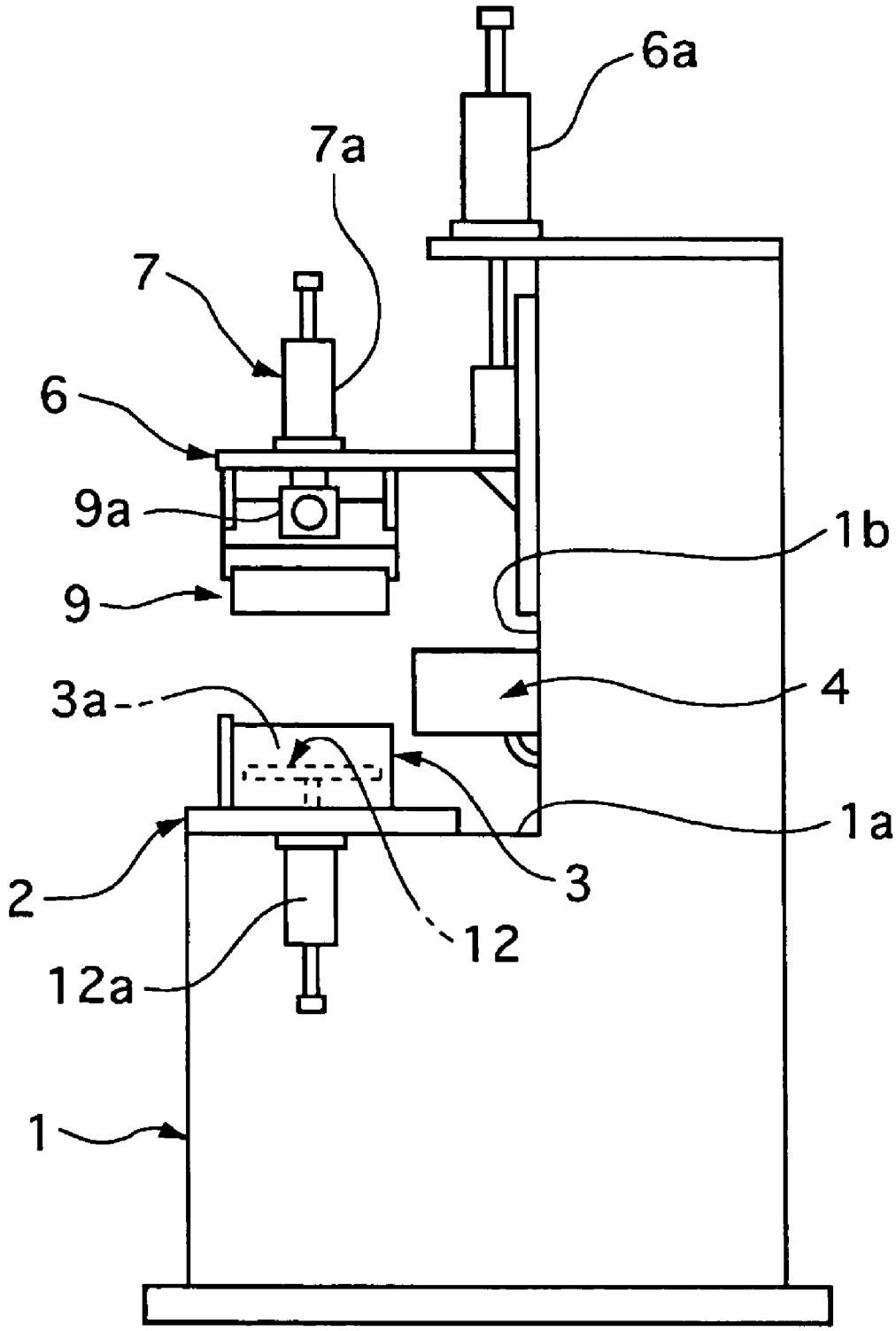
FIG. 2 is a right side view showing the assembly device of the support mat for the ceramic catalyst carrier according to the first embodiment shown in FIG. 1.
Figure 3:
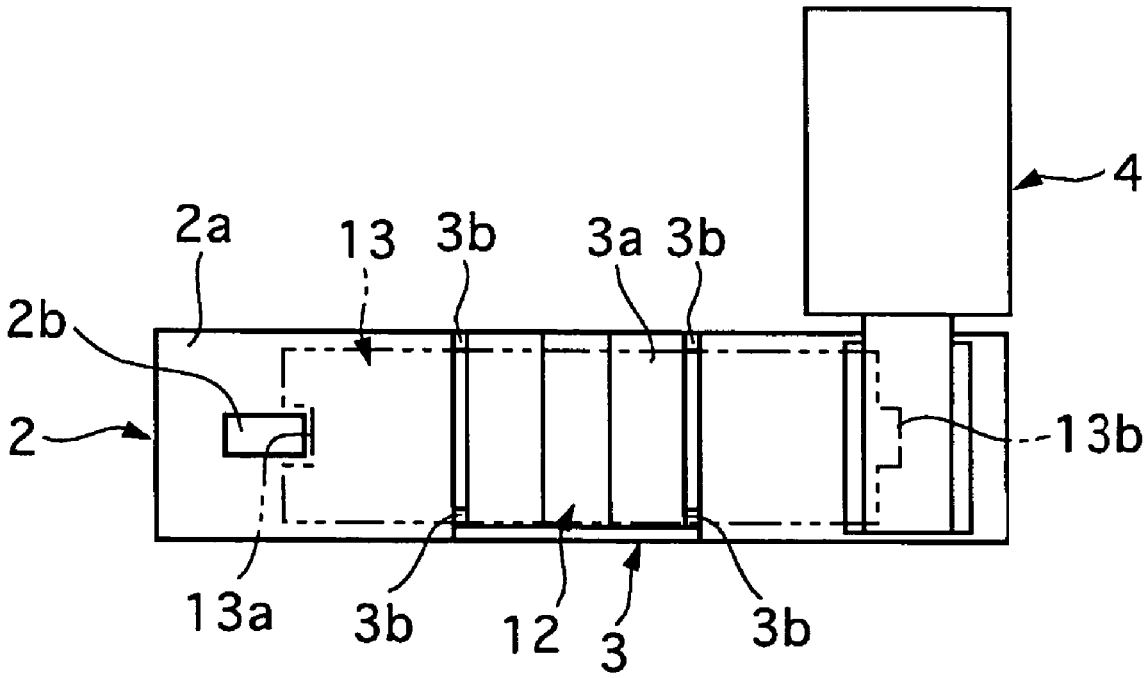
FIG. 3 is a plane view of a base of the assembly device of the support mat for the ceramic catalyst carrier according to the first embodiment shown in FIG. 1.
Figure 4:
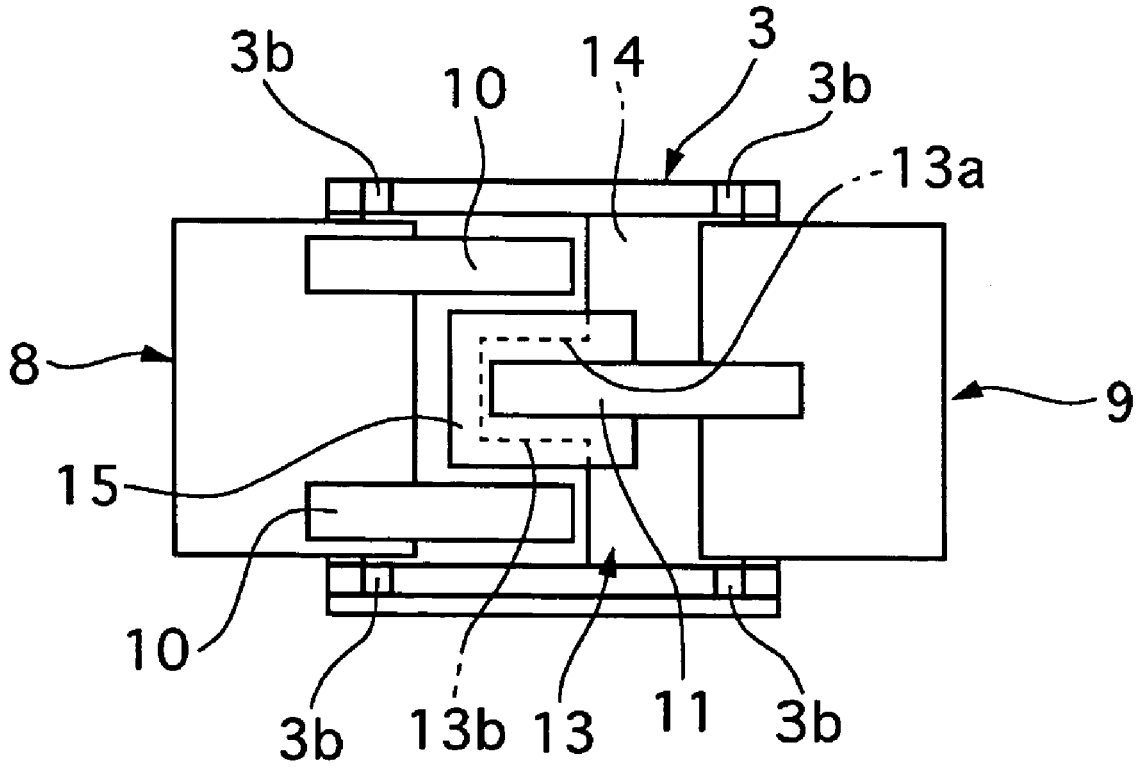
FIG. 4 is a plane view of a main part having first pressing pieces and a second pressing piece to hold edge portions of the support mat in the assembly device of the support mat for the ceramic catalyst carrier according to the first embodiment shown in FIG. 1.

FIG. 1 is a front view showing the assembly device of the support mat for the ceramic catalyst carrier according to the first embodiment, FIG. 2 is a right side view of the same, FIG. 3 is a plane view of a base thereof; and FIG. 4 is a plane view of a main part having first pressing pieces and a second pressing piece to hold edge portions of the support mat.

The assembly device of the support mat 13 for the ceramic catalyst carrier 14 includes a device main body 1, a base 2, a shaping die 3, an automatic tape feeder 4, a tape/support mat pressing unit 5, a tool base 6, a push-in device 7, a first pressing unit 8, a second pressing unit 9, first pressing pieces 10, a second pressing piece 11, and a push-up unit 12.

The device main body 1 is formed to have a substantially L-shaped cross section, with a horizontal surface 1*a* and a vertical surface 1*b*.

The base 2 is fixedly positioned on the horizontal surface 1*a* of the device main body 1, and its upper surface is formed as a flat surface 2*a* capable of holding a support mat 13 in a substantially horizontal state. The support mat 13 is formed in a rectangular shape, having a length long enough to be wound around an outer peripheral surface of a ceramic catalyst carrier 14 in a column shaped. Further, the support mat 13 has in both longitudinal end portions thereof a square-shaped depression 13*a* and a square-shaped projection 13*b* engageable with the depression 13*a*, as shown in FIG. 3 and FIG. 4.

The shaping die 3 is provided on an intermediate portion of the base 2 and has in an upper surface thereof a recession 3*a* having a shape substantially fitting a semicircular bottom surface of the ceramic catalyst carrier 14.

The automatic tape feeder 4 is constructed to feed an adhesive tape 15 onto an upper surface of one end portion, corresponding to a right end portion in FIG. 1, of the base 2 and is fixedly positioned on the vertical surface 1*b* of the device main body 1. Since the automatic tape feeder 4 is a known technique, the structure thereof will not be described in detail herein. Further, the upper surface of the base 2 onto which the adhesive tape 15 is fed is coated with silicon, Teflon, or the like for adhesion prevention.

The tape/support mat pressing unit 5 is constructed to press one end portion of the support mat 13 placed on an upper surface of the adhesive tape 15 toward the adhesive face of the adhesive tape 15 so that the adhesive tape 15 sticks to this one end portion. The tape/support mat pressing unit 5 is turnably disposed in one end portion, corresponding to a right end portion in FIG. 1, of the base 2.

The tool base 6 is disposed above the shaping die 3 to be vertically movable along the vertical surface 1*b* of the device main body 1. The tool base 6 is driven in a vertical direction by a first hydraulic cylinder 6*a* provided in the device main body 1. The tool base 6 acts as a push-in unit of the present invention, and the first hydraulic cylinder 6*a* acts as a first actuator of the present invention.

The push-in device 7 is provided in the tool base 6 to be vertically movable, and it has a function of pushing the ceramic catalyst carrier 14, which is placed on an upper surface of the support mat 13 placed on the upper surface of the base 2, into the recession 3*a* of the shaping die 3 together with the support mat 13. The push-in device 7 also has a function of pressing the vicinity of the engagement portions of the depression 13*a* and the projection 13*b* of the support mat 13 together with the adhesive tape 15 onto an upper surface of the ceramic catalyst carrier 14, with pressing onto upper surfaces of the first pressing pieces 10 and 10 and the second pressing piece 11. A lower surface of the push-in device 7 has an arc shape fitting an arc-shaped upper surface of the ceramic catalyst carrier 14, and an elastic sheet 16 that is made of sponge or low-hardness silicon and has a predetermined elasticity is provided on this arc-shaped surface of the push-in device 7. The push-I device 7 acts as a push-in unit of the present invention, and the elastic sheet 16 corresponds to an elastic presser of the present invention.

The push-in device 7 is driven in a direction perpendicular to the tool base 6 by a second hydraulic cylinder 7*a* provided in the tool base 6. The second hydraulic cylinder 7*a* acts as a second actuator of the present invention.

The first pressing unit 8 and the second pressing unit 9 are provided on the tool base 6 so as to press the both end portions of the support mat 13 from side faces thereof so that the both end portions of the support mat 13 are curved along the arc-shaped upper surface of the ceramic catalyst carrier 14. The first pressing unit 8 and the second pressing unit 9 are horizontally driven toward the ceramic catalyst carrier 14 by a third hydraulic cylinder 8*a* and a fourth hydraulic cylinder 9*a* respectively. The third hydraulic cylinder 8*a* and the fourth cylinder 9*a* act each as an actuator of the present invention.

As shown in FIG. 4, the first pressing pieces 10 and the second pressing piece 11 are integrally provided in tip portions of the first pressing unit 8 and the second pressing unit 9, respectively. Specifically, the first pressing pieces 10 and 10 cover areas of the upper surface of the depression 13*a* side end portion of the support mat 13, excluding the depression 13*a*. The second pressing piece 11 covers an area of the upper surface of the adhesive tape 15 in the projection 13*b* side end portion of the support mat 13, the area corresponding to the projection 13*b*.

The push-up unit 12 is provided on a bottom of the recession 3*a* of the shaping die 3 and it pushes up the ceramic catalyst carrier 14 together with the support mat 13. The push-up unit 12 is vertically driven by a fifth hydraulic cylinder 12*a* provided in the base 2. The fifth hydraulic cylinder 12*a* acts as an actuator of the present invention.

The base 2 has a locking protrusion 2*b* for positioning the support mat 13 placed thereon. In this positioning, the locking protrusion 2*b* is fitted in the depression 13*a* of the support mat 13 to position the depression 13*a* side end portion of the support mat 13.

Positioning protrusions 3*b* are protrudingly formed at respective four corners of an upper periphery of an opening of the recession 3*a* of the shaping die 3, and they are intended for width-direction positioning of an intermediate portion of the support mat 13.

Next, the operations and effects of the assembly device according to the first embodiment will be described.

In the assembly device of the first embodiment, the assembly of the support mat 13 to the ceramic catalyst carrier 14 follows the procedure below.

(a) First, the automatic tape feeder 4 feeds the adhesive tape 15 onto the upper surface of one end portion of the base 2.

(b) Next, the support mat 13 in a flat plate shape is placed on the base 2 horizontally. At this time, the depression 13*a* formed in one end portion of the support mat 13 is locked by the locking protrusion 2*a* for positioning, and the intermediate portion of the support mat 13 is inserted in an area surrounded by the positioning protrusions 3*b* which are protrudingly formed at the respective four corners of the upper periphery of the opening of the recession 3*a* of the shaping die 3, and is locked by the positioning protrusions 3*b*, so that the depression 13*a* side end portion of the support mat 13 and the intermediate portion thereof are positioned in terms of width and longitudinal directions. As a result of this positioning, the projection 13*b* formed in the other end portion of the support mat 13 overlaps the upper surface of the adhesive tape 15.

(c) Next, the tape/support mat pressing unit 5 presses the end portion of the support mat 13 toward the adhesive tape 15, so that the adhesive tape 15 sticks to this end portion.

(d) Next, the push-up unit 12 is moved up by the fifth hydraulic cylinder 12*a* to support the bottom of the support mat 13, and at the same time, the tool base 6 is moved down by the first hydraulic cylinder 6*a* to bring the elastic sheet 16 provided on the arc-shaped lower surface of the push-in device 7 into contact with the upper surface of the ceramic catalyst carrier 14 placed on the upper surface of the support mat 13. In this state, the push-up unit 12 is moved down by the fifth hydraulic cylinder 12*a* and at the same time, the push-in device 7 is moved down by the second hydraulic cylinder 7*a* to push the ceramic catalyst carrier 14 together with the support mat 13 into the recession 3*a* of the shaping die 3. As a result, the intermediate portion of the support mat 13 is curved along the arc-shaped bottom surface of the ceramic catalyst carrier 14 and the both end portions of the support mat 13 are brought into a substantially perpendicularly standing state.

In the above-described push-in processes, the existence of the elastic sheet 16 prevents the pushed upper surface of the ceramic catalyst carrier 14 from being scratched.

(e) Next, the push-up unit 12 and the push-in device 7 are both moved down by the fifth hydraulic cylinder 12*a* and the second hydraulic cylinder 7*a*, respectively.

(f) Next, the first pressing unit 8 and the second pressing unit 9, respectively driven by the third hydraulic cylinder 8*a* and the fourth hydraulic cylinder 9*a*, press the both end portions of the support mat 13 from the side faces so that the end portions are curved along the arc-shaped upper surface of the ceramic catalyst carrier 14. At this time, as shown in FIG. 4, the first pressing pieces 10, 10 provided in the tip portion of the first pressing unit 8 cover the areas of the upper surface of the support mat 13 excluding the depression 13*a* in the depression 13*a* side end portion of the support mat 13, and the second pressing piece 11 provided in the tip portion of the second pressing unit 9 covers the area of the upper surface of the adhesive tape 15 corresponding to the projection 13*b* in the projection 13*b* side end portion of the support mat 13.

(g) Next, the push-in device 7 is moved down by the second hydraulic cylinder 7*a* to push the vicinity of the engagement portions of the depression 13*a* and the projection 13*b* in the support mat 13, together with the adhesive tape 15, from the upper surfaces of the first pressing pieces 10, 10 and the second pressing piece 11 toward the upper surface of the ceramic catalyst carrier 14. When the assembly is finished by this operation, the entire vicinity of the engagement potion of the depression 13*a* and the projection 13*b* together with the adhesive tape 15 are surely curved along the arc-shaped upper surface of the ceramic catalyst carrier 14.

(h) The tool base 6 and the push-up unit 12 are moved up by the first hydraulic cylinder 6*a* and the fifth hydraulic cylinder 12*a* respectively to push the ceramic catalyst carrier 14 having the support mat 13 assembled around the outer periphery thereof out of the recession 3*a* of the shaping die 3.

(i) Next, the push-in device 7 is moved up by the second hydraulic cylinder 7*a*.

(j) Finally, the first pressing unit 8 and the second pressing unit 9 are moved back by the third hydraulic cylinder 8*a* and the fourth hydraulic cylinder 9*a* respectively, and the ceramic catalyst carrier 14 having the support mat 13 assembled thereto is taken out of the device.

The above constructed assembly device of the support mat 13 for the ceramic catalyst carrier 14 can provide the following effects. Work efficiency can be improved as a result of automating many assembly processes, and positioning accuracy in assembling the support mat 13 to the ceramic catalyst carrier 14 can be enhanced, thereby preventing poor conditions that may possibly occur when the assembled body is press-fitted into a container constituting part of an exhaust passage of an exhaust system of an engine.

Moreover, owing to the automatic tape feeder 4 that feeds the adhesive tape 15 onto the upper surface of one of the end portions of the base 2, it is possible to set the adhesive tape 15 at a predetermined position of the base 2 without causing any undesirable variation.

Further, out of the first pressing unit 8 and the second pressing unit 9, the first pressing unit 8 to press the end portion (depression 13*a* side end portion) of the support mat 13 where the adhesive tape 15 is not pasted is first driven, so that the adhesive tape 15 can be surely pasted on the upper surfaces of the engagement portions.

In addition, the tape/support mat pressing unit 5 presses the end portion (projection 13*b* side end portion) of the support mat 13, which is placed on the upper surface of the adhesive tape 15, toward the adhesive tape 15 so that the adhesive tape 15 sticks to the end portion. This structure makes it possible to surely paste the adhesive tape 15 on the end portion of the support mat 13.

Further, after the tape/support mat pressing unit 5 presses the end portion of the support mat 13 toward the adhesive tape 15 to stick the adhesive tape 15 to the end portion, only the first hydraulic cylinder 6*a* need to work to concurrently carry out the two processes: namely, the process of moving down the tool base 6 to bring the push-in device 7 into contact with the upper surface of the ceramic catalyst carrier 14 placed on the upper surface of the support mat 13 while the push-up unit 12 is moved up to support the bottom of the support mat 13; and the process of moving down the first pressing unit 8 and the second pressing unit 9 to the position of the both side faces of the ceramic catalyst carrier 14 when they are to be driven. Therefore, the number of parts can be decreased and work efficiency can be improved.

Moreover, the assembly device has the two first pressing pieces 10 and 10 and the single second pressing piece 11, which are integrally formed in the tip portions of the first pressing unit 8 and the second pressing unit 9 respectively, and has the elastic sheet 16 provided on the pushing surface of the push-in device 7. The first pressing pieces 10 and 10 cover the areas of the upper surface excluding the depression 13 in the depression 13*a* side end portion of the support mat 13, the second pressing piece 11 covers the area of the upper surface corresponding to the projection 13*b* in the projection 13*b* side end portion of the support mat 13, and the elastic sheet 16 has certain thickness and elasticity and when it presses the upper surfaces of the first pressing pieces 10 and 10 and the second pressing piece 11, the adhesive tape 15 can be pressed onto the upper surfaces of the engagement potions of the depression 13*a* and the projection 13*b* of the support mat 13. Therefore, while the first pressing pieces 10 and 10 and the second pressing piece 11 press the engagement portions, the adhesive tape 15 can be pressed from the upper surface of the first pressing pieces 10 and 10 and the second pressing piece 11. This makes it possible to press the entire vicinity of the engagement portions of the depression 13*a* and the projection 13*b* together with the adhesive tape 15 while the end portions of the support mat 13 are surely fitted along the arc-shaped upper surface of the ceramic catalyst carrier 14, so that misalignment and wrinkle of the adhesive tape 15 can be prevented.

Next, an assembly device of a second embodiment will be described with reference of a drawing of FIG. 5. In this embodiment, the same constituent elements as those of the first embodiment will not be shown in the drawing, or are denoted by the same reference numerals or symbols but are not described. Only what are different will be described.

The assembly device of the second embodiment has the same structure as that of the first embodiment except that the position of the automatic tape feeder 4 is changed.

Figure 5:
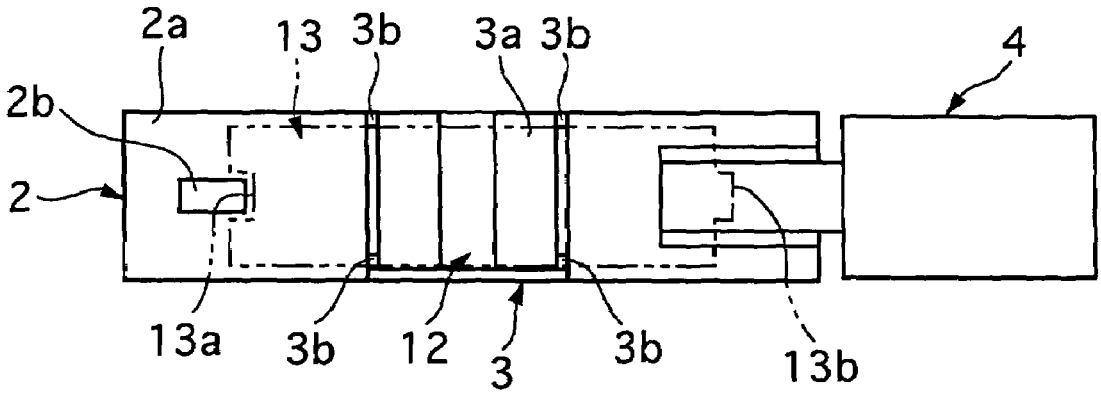
FIG. 5 is a plane view of a base in an assembly device of a support mat for a ceramic catalyst carrier according to a second embodiment of the present invention.
Figure 6A:
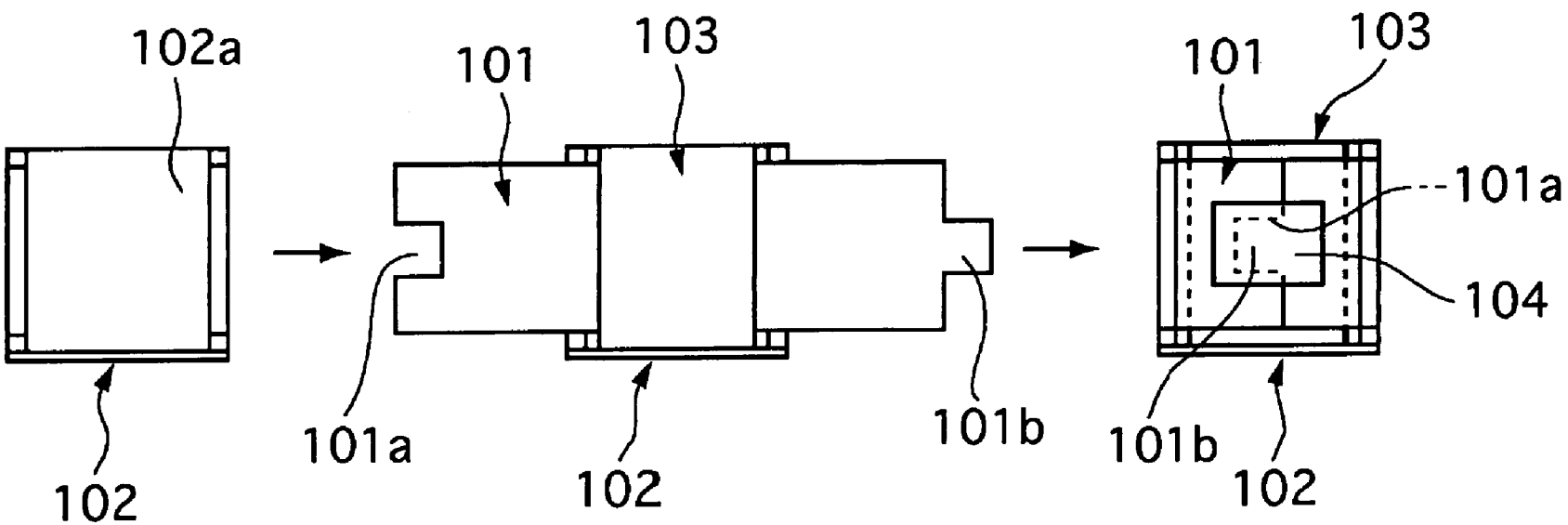
FIG. 6A PRIOR ART
FIG. 6A and FIG. 6B are process charts showing plane and front viewed states of the support mat for the ceramic catalyst carrier in steps of an assembly procedure of them, using a jig in a prior art.
Figure 6B:
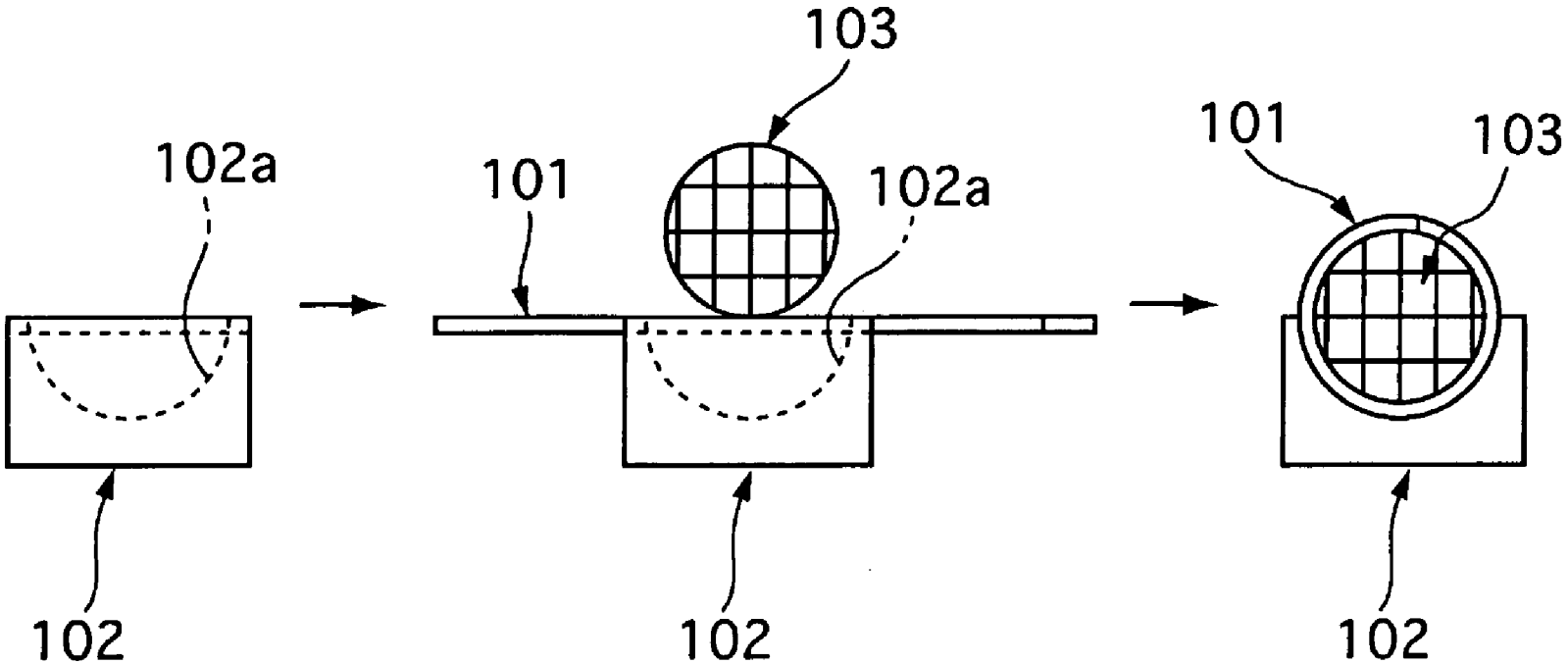
FIG. 6B PRIOR ART

Specifically, the assembly device of the second embodiment is different from that of the first embodiment in that the adhesive tape 15 is fed from an end side of the base 2, as shown in the plane view in FIG. 5.

Hitherto, the embodiments have been described, but the present invention is not limited to the embodiments described above and any design modification and so on without departing from the spirit of the present invention will be embraced in the present invention.

For example, in the embodiments, the hydraulic cylinders are used as the first to fifth actuators, but air cylinders, electric motors, or the like can be used instead of them.

Further, in the embodiments, only one pair of the depression 13*a* and the projection 13*b* is formed in the support mat 13, but the number thereof is arbitrary and the concrete shape thereof is also arbitrary. For example, a bottom portion of the depression 13*a* may be larger than an opening portion of thereof in width and a tip portion of the projection 13*b* may be larger than a base portion thereof in width.

The entire contents of Japanese Patent Application NO. 2003-433761 filed Dec. 26, 2003 is incorporated herein by reference.

What is claimed is:

1. An assembly device of a support mat for a ceramic catalyst carrier, comprising:

a base capable of holding the support mat in a flat plate shape substantially horizontally;

a shaping die provided on an intermediate portion of said base and having a recession that has a shape substantially fitting a semicircular bottom surface of the ceramic catalyst carrier;

a push-in unit capable of pushing the ceramic catalyst carrier together with the support mat into the recession of said shaping die;

a first pressing unit and a second pressing unit that are horizontally driven toward the ceramic catalyst carrier to press both end portions of the support mat from side faces in a state where said push-in unit is moved up to depart from the support mat so as to curve the both end portions of the support mat along an arc-shaped upper surface of the ceramic catalyst carrier, said first pressing unit and said second pressing unit being capable of being pressed toward the both end portions by said push-in unit which is moved downward toward the ceramic catalyst carrier in a state where said first pressing unit and said second pressing unit are horizontally moved toward the ceramic catalyst carrier; and a push-up unit provided on a bottom of the recession in said shaping die and capable of pushing up the ceramic catalyst carrier together with the support mat.

2. The assembly device of the support mat for the ceramic catalyst carrier according to claim 1, wherein the support mat has in the both end portions thereof a depression and a projection engageable with the depression.

3. The assembly device of the support mat for the ceramic catalyst carrier according to claim 1, further comprising an automatic tape feeder to feed an adhesive tape to an upper surface of one end portion of said base.

4. The assembly device of the support mat for the ceramic catalyst carrier according to claim 2, further comprising an automatic tape feeder to feed an adhesive tape to an upper surface of one end portion of said base.

5. The assembly device of the support mat for the ceramic catalyst carrier according to claim 4, wherein one of said first pressing unit and said second pressing unit that is to press one of the end portions of the support mat where the adhesive tape is not pasted is driven before the other one of the first and second pressing units is driven.

6. The assembly device of the support mat for the ceramic catalyst carrier according to claim 5, further comprising a tape/support mat pressing unit that presses the other end portion of the support mat toward the adhesive tape while the other end portion of the support mat is placed on an upper surface of the adhesive tape, thereby sticking the adhesive tape to the other end portion.

7. The assembly device of the support mat for the ceramic catalyst carrier according to claim 6, wherein:said push-in unit is composed of:

a tool base provided above said shaping die and driven by a first actuator to be vertically movable; and a push-in device provided in the tool base and driven by a second actuator to be capable of pushing the ceramic catalyst carrier together with the support mat into the recession of said shaping die; and said first pressing unit and said second pressing unit are provided on the tool base.

8. The assembly device of the support mat for the ceramic catalyst carrier according to claim 7, further comprising:

a plurality of first pressing pieces and at least one second pressing piece that are integrally provided in tip portions of said first pressing unit and said second pressing unit respectively, said first pressing pieces covering areas of an upper surface excluding the depression in the depression-side end portion of the support mat; and said second pressing piece covering an area of the upper surface corresponding to the projection in the projection-side end portion of the support mat; and an elastic presser provided on a pressing surface of said push-in unit, having a thickness and elasticity, and capable of pressing the adhesive tape onto an upper surfaces of engagement portions of the depression and the projection of the support mat by pressing upper surfaces of the first pressing pieces and the second pressing piece.

9. An assembly device of a support mat for a ceramic catalyst carrier, comprising:

a base capable of holding the support mat in a flat plate shape substantially horizontally;

a shaping die provided on an intermediate portion of said base and having a recession that has a shape substantially fitting a semicircular bottom surface of the ceramic catalyst carrier;

a push-in unit capable of pushing the ceramic catalyst carrier together with the support mat into the recession of said shaping die;

a first pressing unit and a second pressing unit that press both end portions of the support mat from side faces so as to curve the both end portions of the support mat along an arc-shaped upper surface of the ceramic;

a push-up unit provided on a bottom of the recession in said shaping die and capable of pushing up the ceramic catalyst carrier together with the support mat; and an automatic tape feeder to feed an adhesive tape to an upper surface of one end portion of said base, wherein one of said first pressing unit and said second pressing unit that is to press one of the end portions of the support mat where the adhesive tape is not pasted is driven before the other one of the first and second pressing units is driven.

10. The assembly device of the support mat for the ceramic catalyst carrier according to claim 9, wherein the support mat has in the both end portions thereof a depression and a projection engageable with the depression.

11. The assembly device of the support mat for the ceramic catalyst carrier according to claim 9, further comprising a tape/support mat pressing unit that presses the other end portion of the support mat toward the adhesive tape while the other end portion of the support mat is placed on an upper surface of the adhesive tape, thereby sticking the adhesive tape to the other end portion.

12. The assembly device of the support mat for the ceramic catalyst carrier according to claim 11, wherein: said push-in unit is composed of:

a tool base provided above said shaping die and driven by a first actuator to be vertically movable; and a push-in device provided in the tool base and driven by a second actuator to be capable of pushing the ceramic catalyst carrier together with the support mat into the recession of said shaping die; and said first pressing unit and said second pressing unit are provided on the tool base.

13. The assembly device of the support mat for the ceramic catalyst carrier according to claim 12, further comprising:

a plurality of first pressing pieces and at least one second pressing piece that are integrally provided in tip portions of said first pressing unit and said second pressing unit respectively, said first pressing pieces covering areas of an upper surface excluding the depression in the depression-side end portion of the support mat; and said second pressing piece covering an area of the upper surface corresponding to the projection in the projection-side end portion of the support mat; and an elastic presser provided on a pressing surface of said push-in unit, having a thickness and elasticity, and capable of pressing the adhesive tape onto an upper surfaces of engagement portions of the depression and the projection of the support mat by pressing upper surfaces of the first pressing pieces and the second pressing piece.

* * * * *